US006576821B1

(12) United States Patent
Chen

(10) Patent No.: US 6,576,821 B1
(45) Date of Patent: Jun. 10, 2003

(54) MUSIC BOX TRANSMITTING MECHANISM

(76) Inventor: Yu-Kai Chen, No. 2-2, Lane 15, Da-Hsing St., Tan-Shui Town, Taipei (TW)

( * ) Notice: Subject to any disclaimer, the term of this patent is extended or adjusted under 35 U.S.C. 154(b) by 0 days.

(21) Appl. No.: 10/016,636

(22) Filed: Nov. 30, 2001

(51) Int. Cl.[7] ..... G10F 1/06
(52) U.S. Cl. ..... 84/95.1; 84/95.2
(58) Field of Search ..... 84/95.1, 95.2, 84/94.1, 96, 97, 98, 99

(56) References Cited

U.S. PATENT DOCUMENTS 5,110,636 A * 5/1992 Hou ..... 40/410
6,174,215 B1 * 1/2001 Shih ..... 40/410
6,329,580 B1 * 12/2001 DeVivo ..... 84/94.1

* cited by examiner

*Primary Examiner*—Kim Lockett
(74) *Attorney, Agent, or Firm*—Mathews, Collins, Shepherd & McKay, P.A.

(57) ABSTRACT

A music box transmitting mechanism for a music box includes a bottom rotating member rotating in one direction and a top rotating member having an inner rotatable member rotating in a direction opposite to that of the bottom rotating member. Furthermore, a transmitting member acting on the music box can transmit the kinetic energy from the power device to the inner rotatable member at a long distance.

7 Claims, 4 Drawing Sheets

MUSIC BOX TRANSMITTING MECHANISM

FIELD OF THE INVENTION

The present invention relates to a music box transmitting mechanism, and more particular, the present invention relates to a transmitting mechanism, wherein an inner rotatable member in a liquid container rotating in an opposite direction to that of a bottom rotating member.

BACKGROUND OF THE INVENTION

Currently, various music box-incorporated ornamental display assemblies have been disclosed and have appeared on the market, such as carrousels or the like. These ornamental display assemblies are rotated or reciprocated by the drive mechanism of a wind-up music box mechanism through a transmitting mechanism. However, conventional transmitting mechanisms for use with wind-up music box mechanism are commonly complicated and expensive.

In addition, such kinds of devices are often provided with a plurality of decorative ornaments and may often be provided with a mechanism to cause the decorative ornament to move as the music drum rotates. The decorative ornament is usually mounted on a support member, which is associated with the drive mechanism to provide the movement to the decorative ornament.

In order to provide reciprocating movement or rotational movement to different decorative objects of the ornamental display assembly, it is known to use an output shaft of the music drum to provide the power source for the reciprocating movement of a decorative element and to make use of the unwinding phenomenon of spring to provide the rotational movement for a separate decorative ornament. When this concept is applied to a variety of movements of the decorative elements, separate drive mechanisms are required and the decorative elements must be laterally spaced apart on the ornamental display assembly. Such an arrangement inherently requires a complex drive system to provide the desired motion to the decorative ornaments and needs a larger space.

Accordingly, the toy maker has tried to miniaturize the turnabout and has presented a variety of turnabout toys capable of rotating as the turnabout in the amusement field does and these toys are loved very much by many people regardless of adults and children. Taking our invention, U.S. Pat. No. 5,276,271 granted on Jan. 4, 1994, as an example shown in FIG. 1, the music box 4 at the bottom of a mount case 3 thereof provides a transmitting member 1 with a stirring wheel 43 to transmit the energy to the rotating casing 12 rotating in a direction. Further, the main shaft 41 with a decoration umbrella 2 at the upper part thereof may rotate with the shaft 41 synchronously in a direction opposite to that of the rotating casing 12. According to this prior art, some people develop transmitting mechanisms having an inner rotatable member rotating in a liquid container. The crux of the prior art resides in that an inner rotatable member in a liquid container gains the kinetic energy from the power device and then rotates in one direction. It is hard to directly transmit the energy from the power device to the inner rotatable member because the inner rotatable member in a liquid container can't directly with the power device. On the other hand, it is another problem to prevent the water in the container from leaking. Hence, many people develop various transmitting mechanisms.

However, ordinary inventions always provide a sophisticate device and make the production cost increase greatly.

Moreover, the inner rotatable member in a liquid container with a decoration article usually can't move smoothly because of the drag of water and the friction among transmitting elements. On the other hand, there is another problem about the transmitting distance. Since the inner rotatable member is far from the power device, there should be a long transmitting member to successfully transmit the kinetic energy without leaking any liquid in the container. The kinetic energy, however, is easy to be consumed in a long-distance transmission. Hence, it is hard for the player to have a feeling like playing the actual turnabout while a toy with a device of the prior art is used.

SUMMARY OF THE INVENTION

It is one object of the present invention to provide a transmitting mechanism for a music box ornament, which is simple in structure and inexpensive to manufacture.

It is another object of the present invention to provide an ornamental display assembly having decorative elements rotated in opposite directions, which are actuated by a common power source.

It is another object of the present invention to provide a transmitting mechanism having a long-distance transmitting member to successfully transmit the less kinetic energy without leaking any liquid in the container and consuming the kinetic energy.

According to the present invention, a music box transmitting mechanism comprises a bottom rotating member having a driven gear and rotating in one direction, a top rotating member having a liquid container and an inner rotatable member rotating in a direction opposite to that of the bottom rotating member, a base foundation having a power device and containing the bottom rotating member, and a transmitting member having a transmitting rod for transmitting the kinetic energy from the power device to the top rotating member.

Certainly, the base foundation can have a decorative casing, a disk having a central hole and the power device being a music producing and driving unit having a stirring wheel, a top shaft and a bottom shaft passing through the central hole of the disk.

Certainly, the liquid container can be fixed on the base foundation and have a bottom hole with a waterproof pad. The inner rotatable member can have a disk and a bottom fixing part passing through the waterproof pad and the top rotating member further comprises a decoration disposed on the disk.

Certainly, the power device can have a top shaft and the transmitting member can further comprise a limiting stick fastened to the top shaft, a transmitting device fixed on the limiting stick, and the transmitting rod having a top fixed part locked in the inner rotatable member.

Preferably, the transmitting device can comprise a disk secured to the top of the limiting stick and a plurality of peripheral projective cylinders.

Preferably, the inner rotatable member can have a bottom fixing part and the transmitting rod can further comprise the top fixed part locked in the bottom fixing part, a bottom part having a plurality of radiate projective cylinders and engaging with the transmitting device, and a stick connecting the top fixed part and the bottom part.

Preferably, the power device can have a stirring wheel. The transmitting member can have a limiting stick and the bottom rotating member can further comprise a rotating casing having a central hole, a driven gear having a central hole and fixed in the rotating casing, a driving gear disposed on the stirring wheel, and a transmitting gear disposed on the power device aside and meshing with the driven gear and the driving gear, wherein the rotating casing and the driven gear are sequentially passing therethrough the limiting stick.

Certainly, the liquid container can contain water inside.

The present invention may best be understood through the following description with reference to the accompanying drawings, in which:

DETAILED DESCRIPTION OF THE PREFERRED EMBODIMENTS

Figure 1:
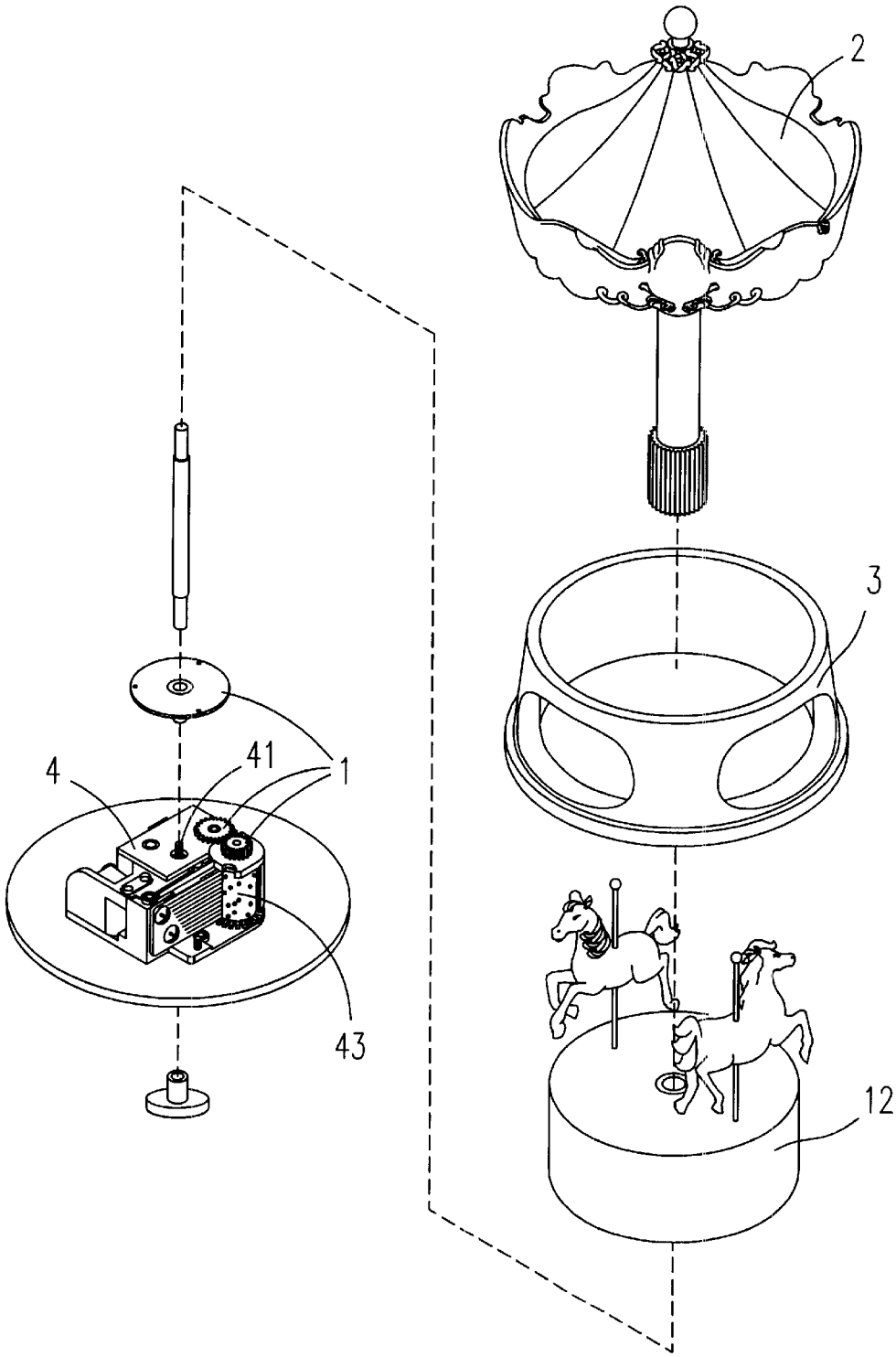
Fig. 1(PRIOR ART)
FIG. 1 is an exploded perspective view of a music box transmitting mechanism according to the prior art.
Figure 2:
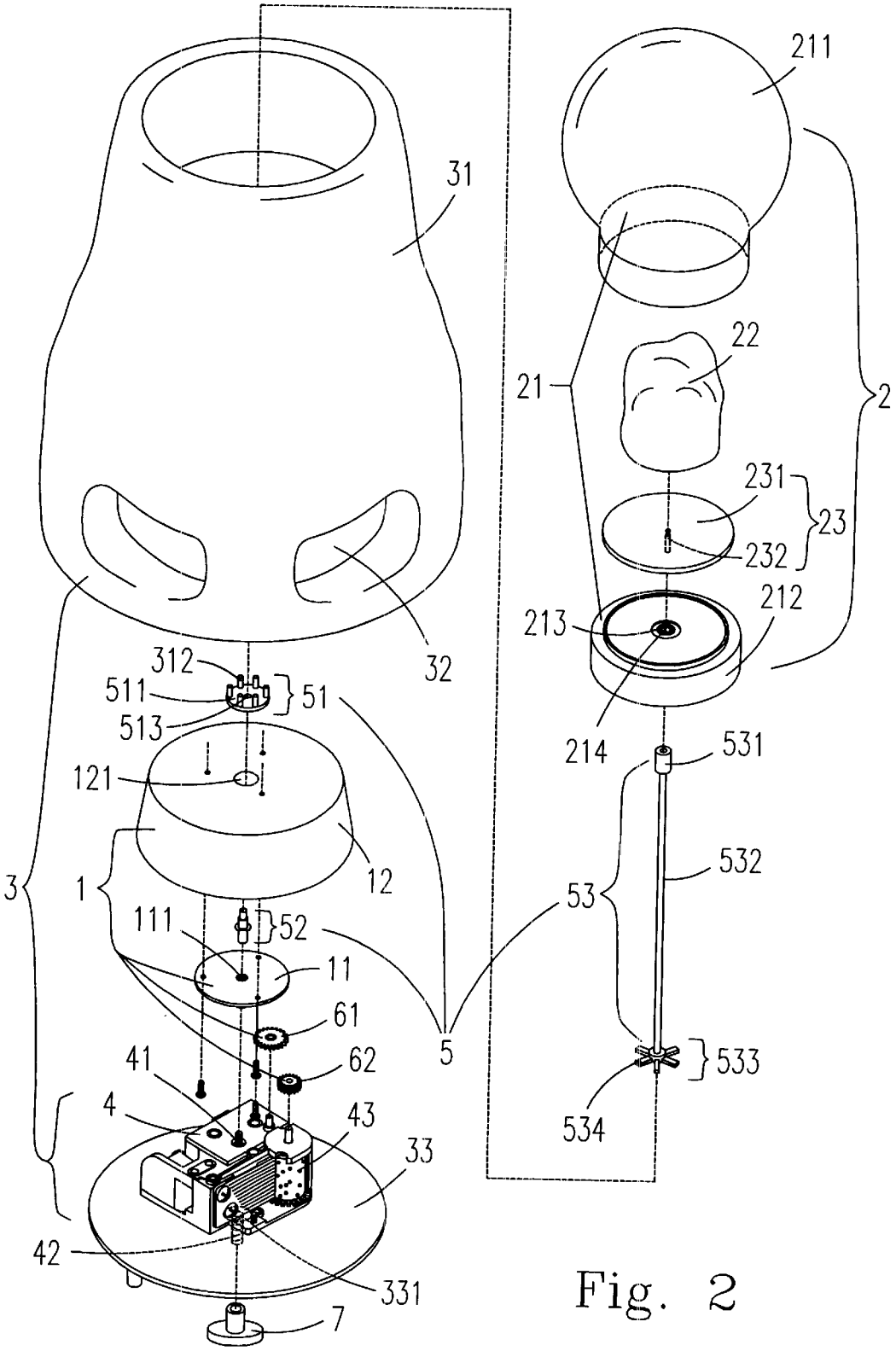
FIG. 2 is an exploded perspective view of a music box transmitting mechanism according to the present invention.
Figure 3:
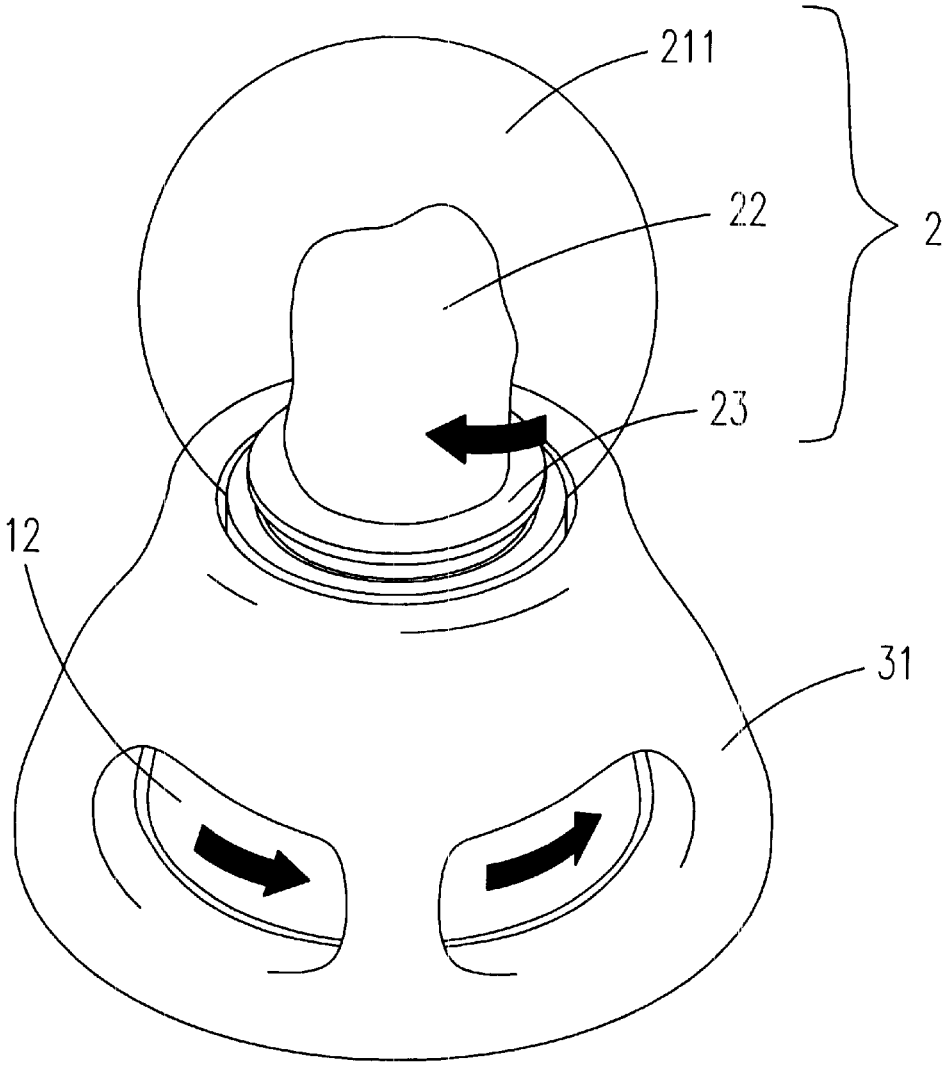
FIG. 3 is an assembled perspective view of the transmission mechanism shown in FIG. 2.
Figure 4:
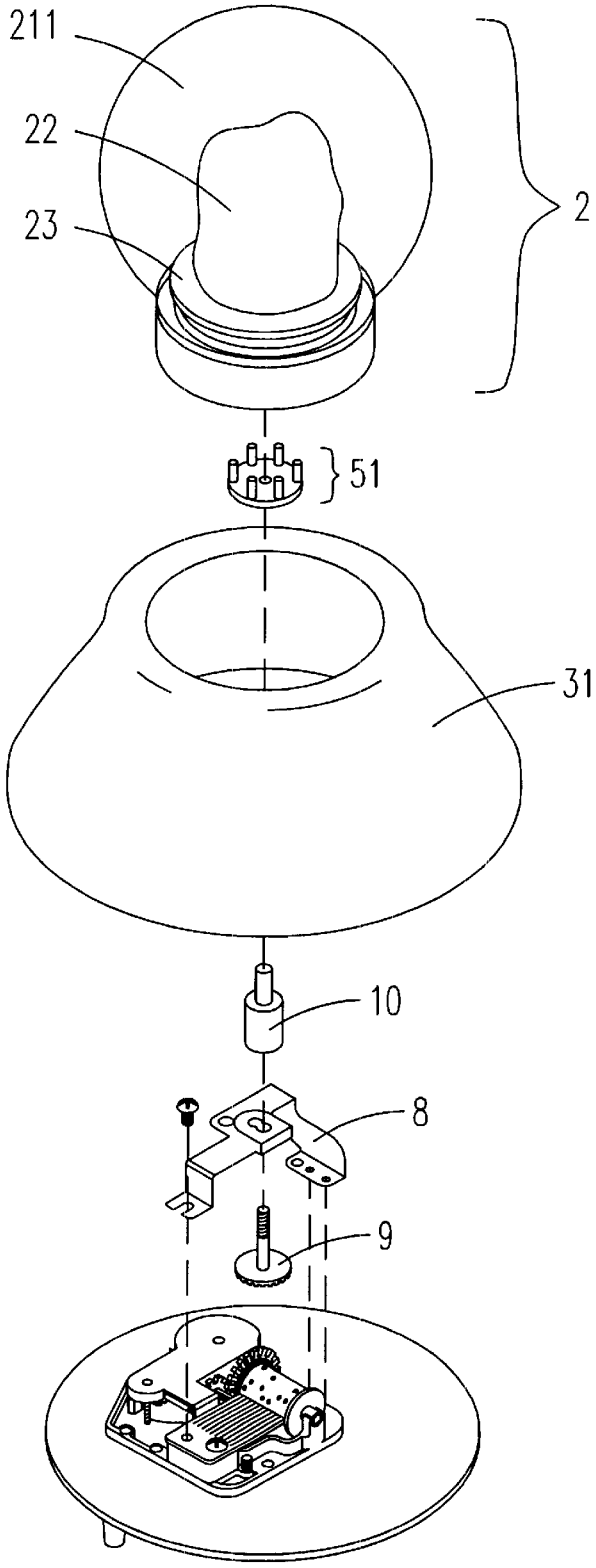
FIG. 4 is another exploded perspective view of a music box transmitting mechanism according to the present invention.

Referring to FIGS. 2 to 4, a music box transmitting mechanism according to the present invention basically comprises a bottom rotating member 1, a top rotating member 2, a transmitting member 5, and a base foundation 3 having a power device 4 fixed on a disk 33.

Wherein, the base foundation 3 furthermore comprises a decorative casing 31 having plural openings 32, a disk 33 having a central hole 331 and fixed in the bottom of the decorative casing 31, and a power device 4 having a stirring wheel 43. The power device being a music producing and driving unit 4 is a moving source and a shaft 42 extends downward from the bottom thereof to fixedly engage with the spring device 7 through the disk 33. Beside, the power device 4, as shown in the figures, may be a conventional music bell having components respectively corresponding to a top shaft 41, a bottom shaft 42 and a stirring wheel 43 disposed beside of the shaft 41. The disk 33 provides an axial hole 331 to be passed through by the shaft 42.

The bottom rotating member 1 furthermore comprises a rotating casing 12 having a central hole 121, a driven gear 11 having a central hole 111 and fixed in the rotating casing 12, a driving gear 62 disposed on the stirring wheel 43, and a transmitting gear 62 fixed on the power device 4 aside and meshing with the driven gear 11 and the driving gear 62, wherein the central hole of the rotating casing 12 and the central hole of the driven gear 11 sequentially pass therethrough the limiting stick 52 of the transmitting member 5. When the power device 4 rotates the stirring wheel 43, the driving gear 62 disposed on the stirring wheel 43 rotates and meshes with the transmitting gear 62. At the same time, the transmitting gear 61 meshes with the driving gear 62 and the driven gear 11 and transmits the kinetic energy to the driven gear 11. Then, the rotating casing 12 and the driven gear 11 fixed in the rotating casing 12 rotate in the same direction as that of the driving gear 62 and the stirring wheel 43.

As shown in the figures, the top rotating member 2 furthermore comprises a liquid container 21 fixed on the top of the decorative casing 31, a waterproof pad 213 having a central hole 214 and fixed in base part 212 of the liquid container 21, and an inner rotatable member 23, wherein the inner rotatable member 23 has a disk 231, a bottom fixing part 232 passing through the waterproof pad 213 and a decoration 22 disposed on the disk 231. The inner rotatable member 23 gains the kinetic energy through the transmitting member 53 and rotates in an opposite direction.

The transmitting member comprises a transmitting rod 53 having a top fixed part 531 for locking a bottom fixing part 232 of the inner ratatable member 23, a limiting stick 52 fastening on a top shaft 41 of the power device 4, and a transmitting device 51 fixed on the limiting stick 52, wherein the transmitting device furthermore comprises a disk 511 secured to the top of the limiting stick 52 and a plurality of peripheral projective cylinders 312; and the bottom part 533 of the transmitting rod 53 meshes with the transmitting device 51. Hence, the transmitting member 5 can transmit the kinetic energy from the power device 4 to the top rotating member 2 and the inner rotatable member 23 can rotate in a direction opposite to that of the rotating casing 12. Shown as FIG. 3, when the music box starts to be running, the inner rotatable member 23 in the liquid container 21 rotates counterclockwise and the rotating casing 12 rotates clockwise.

According to the present invention, the transmitting member 5 can be simplified by changing the length of the transmitting rod 53 or removing the middle rod 532. On the other hand, it is easy for the present invention to be applied in another type of power device without a top shaft. As shown in the FIG. 4, the transmitting device 51 deposed on a frame 8 and secured to a driven gear 9 also can transmit the kinetic energy in the same way as that shown in FIG. 2.

It is appreciated from the preceding descriptive explanations of preferred embodiments that the music box transmitting mechanism according to the present invention provides simplified component parts to make the assembly job be accomplished in a fast manner so as to lower down the production cost greatly.

Although the present invention has been described and illustrated in detail, it is to be clearly understood that the same is by ways of illustrations and examples only and is not to be taken by way of limitations, the spirit and scope of the present invention being limited only by the terms of the appended claims.

What is claimed is:

1. A music box transmitting mechanism, comprising:

a bottom rotating member having a driven gear and rotating in one direction;

a top rotating member having a liquid container and an inner rotatable member rotating in a direction opposite to that of said bottom rotating member;

a base foundation having a power device and containing said bottom rotating member;

a transmitting member having a transmitting rod for transmitting the kinetic energy from said power device to said top rotating member, wherein said liquid container is fixed on said base foundation and has a bottom hole with a waterproof pad;

said inner rotatable member having a disk and a bottom fixing part passing through said waterproof pad; and said top rotating member further comprising a decoration disposed on said disk.

2. The music box transmitting mechanism according to claim 1, wherein said base foundation has a decorative casing, a disk having a central hole, and said power device being a music producing and driving unit having a stirring wheel, a top shaft and a bottom shaft passing through said central hole of said disk.

3. The music box transmitting mechanism according to claim 1, wherein said power device has a top shaft and said transmitting member further comprises:

a limiting stick fastened to said top shaft;

a transmitting device fixed on said limiting stick; and said transmitting rod having a top fixed part locked in said inner rotatable member.

4. The music box transmitting mechanism according to claim 3, wherein said transmitting device comprises a disk secured to the top of said limiting stick and a plurality of peripheral projective cylinders.

5. The music box transmitting mechanism according to claim 3, wherein said inner rotatable member has a bottom fixing part and said transmitting rod further comprises:

said top fixed part locked in said bottom fixing part;

a bottom part having a plurality of radiate projective cylinders and engaging with said transmitting device; and a stick connecting said top fixed part and said bottom part.

6. The music box transmitting mechanism according to claim 1, wherein said power device has a stirring wheel, said transmitting member has a limiting stick and said bottom rotating member further comprises:

a rotating casing having a central hole;

a driven gear having a central hole and fixed in said rotating casing;

a driving gear disposed on said stirring wheel; and a transmitting gear disposed on said power device aside and meshing with said driven gear and said driving gear, wherein said rotating casing and said driven gear are sequentially passing therethrough said limiting stick.

7. The music box transmitting mechanism according to claim 1, wherein said liquid container contains water inside.

* * * * *